US011653806B2

(12) United States Patent
Li et al.

(10) Patent No.: US 11,653,806 B2
(45) Date of Patent: May 23, 2023

(54) AUTONOMOUS CLEANING ROBOT

(71) Applicant: Shenzhen Rock Times Technology Co., Ltd., Shenzhen (CN)

(72) Inventors: Xing Li, Shenzhen (CN); Song Peng, Shenzhen (CN); Youcheng Lu, Shenzhen (CN)

(73) Assignee: SHENZHEN ROCK TIMES TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/395,547

(22) Filed: Aug. 6, 2021

(65) Prior Publication Data

US 2021/0361137 A1 Nov. 25, 2021

Related U.S. Application Data

(63) Continuation of application No. 16/330,395, filed as application No. PCT/CN2017/113960 on Nov. 30, 2017, now Pat. No. 11,109,730.

(30) Foreign Application Priority Data

Jan. 26, 2017 (CN) ..... 201710061574.3

(51) Int. Cl.
*A47L 11/28* (2006.01)
*A47L 11/40* (2006.01)
(Continued)

(52) U.S. Cl.
CPC ..... *A47L 11/28* (2013.01); *A47L 9/0477* (2013.01); *A47L 9/0686* (2013.01);
(Continued)

(58) Field of Classification Search
CPC ..... A47L 11/204; A47L 9/1409; A47L 11/28; A47L 11/4083; A47L 2201/00;
(Continued)

(56) References Cited

U.S. PATENT DOCUMENTS 8,898,844 B1 12/2014 Dooley et al.
10,292,553 B1 * 5/2019 Ebrahimi Afrouzi ..... A47L 5/00
(Continued)

FOREIGN PATENT DOCUMENTS

CN 201939277 U 8/2011
CN 202445993 U 9/2012
(Continued)

OTHER PUBLICATIONS

Extended European Search Report issued in corresponding European Patent Application No. 21195129.8 dated Jan. 5, 2022.
(Continued)

*Primary Examiner* — David Redding
(74) *Attorney, Agent, or Firm* — Morgan, Lewis & Bockius LLP

(57) ABSTRACT

The present disclosure relates to an autonomous cleaning robot. The autonomous cleaning robot may include a main body (1) and a cleaning assembly. The cleaning assembly is mounted on the main body (1). The cleaning assembly may include a first cleaning subassembly (2) removable and provided on the main body (1). The first cleaning subassembly (2) is moved in the forward direction or the backward direction of the main body (1) when the first cleaning subassembly (2) is loaded or removed from the main body (1). The first cleaning subassembly (2) is removable and connected to the main body (1) through a connecting member.

16 Claims, 17 Drawing Sheets

(51) Int. Cl.
*A47L 9/04* (2006.01)
*A47L 9/06* (2006.01)

(52) U.S. Cl.
CPC ..... *A47L 11/4005* (2013.01); *A47L 11/4016* (2013.01); *A47L 11/4027* (2013.01); *A47L 11/4041* (2013.01); *A47L 11/4058* (2013.01); *A47L 11/4072* (2013.01); *A47L 11/4083* (2013.01); *A47L 11/4088* (2013.01); *A47L 2201/04* (2013.01); *A47L 2201/06* (2013.01)

(58) Field of Classification Search
CPC .... A47L 11/40; A47L 11/4088; A47L 11/408; A47L 9/0477; A47L 9/0686; A47L 11/4005; A47L 11/4016; A47L 11/4027; A47L 11/4041; A47L 11/4058; A47L 11/4072; A47L 2201/04; A47L 2201/06; A47L 9/0466; A47L 11/4036; A47L 11/4094
See application file for complete search history.

(56) References Cited

U.S. PATENT DOCUMENTS

| | | | | |
|---|---|---|---|---|
| 2007/0061040 | A1* | 3/2007 | Augenbraun | B25J 9/0003 700/245 |
| 2012/0199006 | A1* | 8/2012 | Swett | A47L 9/2805 96/417 |
| 2013/0174371 | A1 | 7/2013 | Jones et al. | |
| 2014/0223678 | A1 | 8/2014 | Chiu et al. | |
| 2016/0150934 | A1* | 6/2016 | Kim | A47L 9/0686 15/300.1 |

FOREIGN PATENT DOCUMENTS

| | | | |
|---|---|---|---|
| CN | 204379171 | U | 6/2015 |
| CN | 204600371 | U | 9/2015 |
| CN | 204698453 | U | 10/2015 |
| CN | 204813712 | U | 12/2015 |
| CN | 205181254 | U | 4/2016 |
| CN | 106108776 | A | 11/2016 |
| JP | S7-8189 | Y | 7/1932 |
| JP | S63-008856 | U | 1/1988 |
| JP | H09-6516 | A | 1/1997 |
| JP | H11-99112 | A | 4/1999 |
| JP | 2004-202149 | A | 7/2004 |
| JP | 2008-061678 | A | 3/2008 |
| JP | 2011-030665 | A | 2/2011 |
| JP | 2012-115347 | A | 6/2012 |
| JP | 3194306 | U | 11/2014 |
| JP | 2016-107094 | A | 6/2016 |
| KR | 10-1015465 | B1 | 2/2011 |
| KR | 10-2012-0042391 | A | 5/2012 |
| KR | 10-2012-0129192 | A | 11/2012 |
| WO | 2016/107577 | A1 | 7/2016 |

OTHER PUBLICATIONS

Extended European Search Report issued in corresponding European Patent Application No. 21195096.9 dated Jan. 21, 2022.
Notice of Reasons for Refusal issued in counterpart Japanese Patent Application No. 2021-059030 dated Mar. 20, 2022.
Notice of Reasons for Refusal issued in counterpart Japanese Patent Application No. 2021-059036 dated Mar. 20, 2022.
Office Action dated Dec. 6, 2022, issued in corresponding Japanese Patent Application No. 2021-059036.

* cited by examiner

AUTONOMOUS CLEANING ROBOT

CROSS-REFERENCE TO RELATED APPLICATION

This application is a continuation application of U.S. application Ser. No. 16/330,395, which is based upon and claims priority to a Chinese patent application No. 2017100615743 titled "AUTONOMOUS CLEANING ROBOT" and filed on Jan. 26, 2017. The entirety of the above-mentioned application is hereby incorporated by reference herein.

TECHNICAL FIELD

The present disclosure relates to cleaning equipment, and more particularly, to an autonomous cleaning robot.

BACKGROUND

With the development of technology, a variety of autonomous cleaning robots have appeared, for example, automatic sweeping robots, automatic mopping robots, and so on. An autonomous cleaning robot can automatically perform cleaning operations in a user-friendly way. Taking the automatic sweeping robot as an example, the automatic sweeping robot can automatically clear an area by scraping and using vacuum cleaning technology. The scraping operation can be achieved by automatically cleaning the bottom of the device with a scraper and a roller brush.

For an autonomous cleaning robot with a mopping function, it is often needed to set up a water tank on the robot to provide the water source required for the mopping. Normally, the water tank is connected to the robot at a bottom thereof. The bottom of the robot always needs to be turned upside down to install or disassemble the water tank therefrom.

SUMMARY

Embodiments of the present disclosure provide an autonomous cleaning robot.

Embodiments of the present disclosure provide an autonomous cleaning robot. The autonomous cleaning robot may include a main body and a cleaning assembly. The cleaning assembly is mounted on the main body. The cleaning assembly may include a first cleaning subassembly that is removable and mounted on the main body. When the first cleaning subassembly is loaded or removed from the main body, the first cleaning subassembly is moved in the forward direction or the backward direction of the main body. The first cleaning subassembly is removable and connected to the main body through a connecting member.

DETAILED DESCRIPTION

The autonomous cleaning robot of the embodiments of the present disclosure will be described in detail with reference to the accompanying drawings.

Definition of Nouns

Use of the terminology "forward" refers to the primary direction of motion of the autonomous cleaning robot.

Use of the terminology "backward" refers to the opposite direction of primary direction of motion of the autonomous cleaning robot.

According to embodiments of the present disclosure, an autonomous cleaning robot is provided, including a main body 1 and a cleaning assembly. The main body 1 is configured to support other structures, i.e., the cleaning assembly provided on the main body 1. The cleaning assembly may include a first cleaning subassembly 2 that is removable and mounted on the main body 1. When the first cleaning subassembly 2 is loaded onto or removed from the main body 1, the first cleaning subassembly 2 moves in the forward direction of the main body 1. The first cleaning subassembly 2 is removable and connected to the main body 1 through a connecting member. The first cleaning subassembly 2 moves in the forward direction (or the backward direction) of the main body 1 when it is mounted on the main body 1 or removed from the main body 1. Normally, the forward direction of the main body 1 is in the horizontal direction so that the loading and removal of the first cleaning subassembly 2 is more convenient. The autonomous cleaning robot of the embodiments solves the problem that the bottom of the robot always needs to be turned upside down to install or disassemble the water tank therefrom. The replacement and maintenance of the first cleaning subassembly 2 are more convenient. The first cleaning subassembly 2 is removable and connected to the main body 1 by the connecting member so that the connection is more reliable. The bottom of the robot always needs to be turned upside down to install or disassemble the water tank therefrom.

Figure 1:
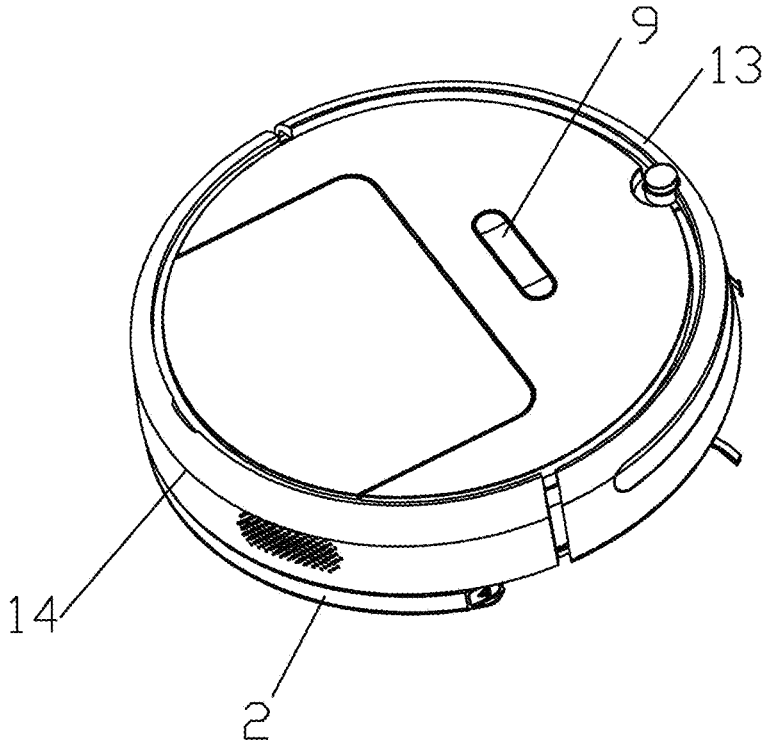
FIG. 1 illustrates a schematic view of a first view of an autonomous cleaning robot, in accordance with embodiments of the present disclosure.
Figure 2:
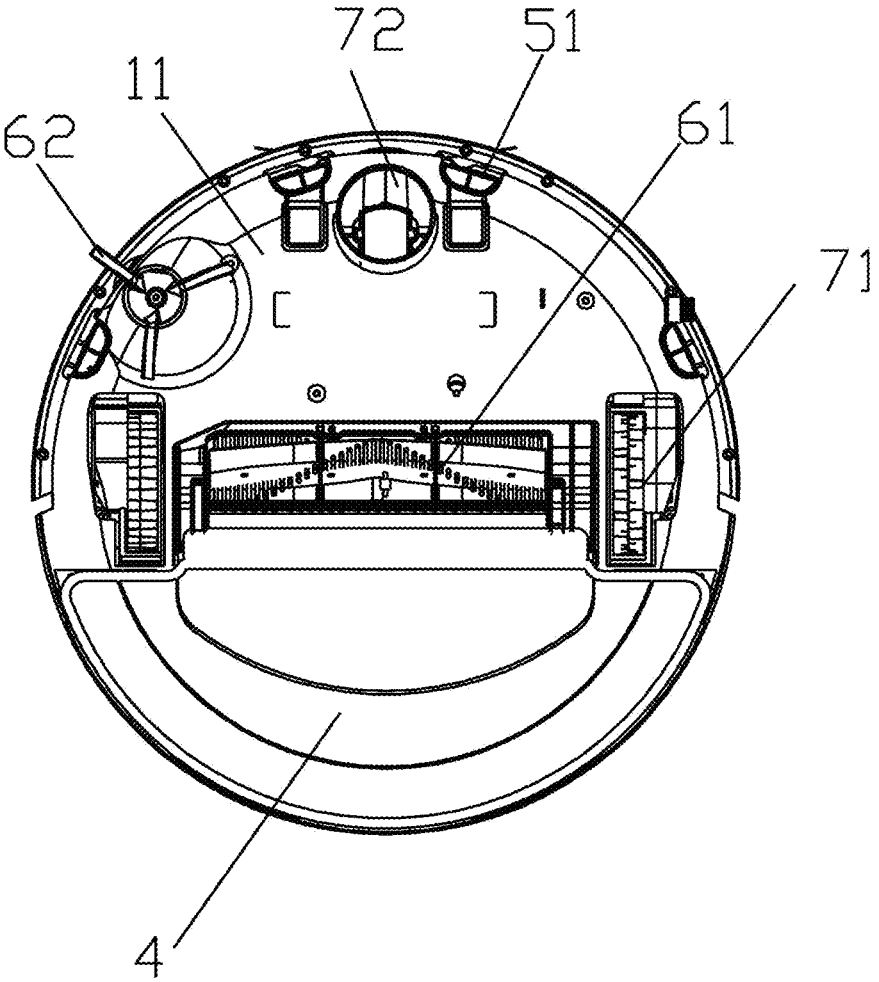
FIG. 2 illustrates a schematic view of a second view of an autonomous cleaning robot, in accordance with embodiments of the present disclosure.

As shown in FIGS. 1 and 2, the autonomous cleaning robot may be, but is not limited to, a smart sweeping robot, a solar panel robot or a building exterior cleaning robot. The embodiments of the present disclosure will be described with reference to a smart sweeping robot.

The autonomous cleaning robot may include a sensing system, a control system (not shown), a drive system, an energy system and a human-computer interaction system 9, in addition to the main body 1 and the cleaning assembly. The main parts of the autonomous cleaning robot will be described in detail below.

The main body 1 may include an upper cover, a forward part 13, a backward part 14, and a chassis 11. The main body 1 has an approximately cylindrical configuration with minimal height (both front and rear are circular shaped). The main body 1 may have other shapes, including but not limited to an approximately D-shaped form with a front square and a rear circle.

The sensing system may include a position-determining device located above the main body 1, a buffer located at the forward part 13 of the main body 1, a cliff sensor 51 and an ultrasonic sensor, an infrared sensor, a magnetometer, an accelerometer, a gyroscope, an odometer and other sensing devices. These sensing devices provide the control system with various location information and motion-status information of the robot. The position determining device may include, but is not limited to, an infrared transmitting and receiving device, a camera, and a laser distance-measuring device (LDS).

The cleaning assembly may include a dry-cleaning subassembly and a wet-cleaning subassembly. The wet-cleaning subassembly is the first cleaning subassembly 2, and the first cleaning subassembly 2 is configured to wipe the surface (e.g., ground) with the cleaning cloth 4 containing the cleaning liquid. The dry-cleaning subassembly is a second cleaning subassembly, configured to clean solid contaminants on the surface cleaned by a cleaning brush or the like.

As the dry-cleaning subassembly, the main cleaning function is caused by the second cleaning subassembly including a roller brush 61, a dust cartridge, a fan, an air outlet, and a connecting member therebetween. The roller brush 61 has a certain interference with the ground, sweeps dusts on the floor and rolls it in front of the suction port between the roller brush 61 and the dust cartridge. Then, the dusts are sucked into the dust cartridge by the suction gas generated by the fan and through the dust cartridge. The dust-removal capacity of the sweeping machine can be characterized by the dust pick-up efficiency (DPU). The DPU is influenced by the structure and material of the roller brush 61; the wind power utilization ratio of a duct formed by the suction port, the dust cartridge, the fan, the air outlet and the connecting member therebetween; and the type and power of the fan. Compared to the ordinary plug-in vacuum cleaner, the improvement of dust-removal capacity for energy-limited cleaning robots is more meaningful because the increase in dust-removal capacity directly reduces the demand for energy. In other words, the robot charges that once could clean 80 square meters of ground can evolve to clean 100 square meters or more. And because of the reduction of the number of charges, the service life of the battery will be greatly increased, and the frequency of replacing the battery will be decreased. More intuitive and important, the improvement of dust-removal capacity is a most obvious and important user experience benefit, and the user will directly find out whether the cleaning and wiping are sufficient. The dry-cleaning assembly may also include a side brush 62 provided with a rotating shaft. The rotating shaft is angled relative to the ground for moving the debris into the cleaning area of the roller brush 61 of the second cleaning subassembly.

As the wet-cleaning subassembly, the first cleaning subassembly 2 may mainly include a liquid container 3 and a cleaning cloth 4 and the like. The liquid container 3 serves as a base for supporting other components of the first cleaning subassembly 2. The cleaning cloth 4 is removable and provided on the liquid container 3. The liquid in the liquid container 3 flows to the cleaning cloth 4. The cleaning cloth 4 wipes the ground after the ground cleaning by the roller brush or the like.

The drive system is configured to drive the main body 1 and components mounted on the main body to move for automatic travel and cleaning. The drive system may include a drive-wheel module 71. The drive system can issue a drive command to manipulate the robot to travel across the ground. The drive command is based on distance information and angle information, such as x, y and θ components. The drive-wheel module 71 can simultaneously control the left wheel and right wheel. For controlling the movement of the machine, preferably the drive-wheel module 71 may include a left drive-wheel module and a right drive-wheel module. The left drive-wheel module and the right drive-wheel module are opposed to each other along a lateral axis defined by the main body 1. In other words, the left drive-wheel module and the right drive-wheel module are symmetrical. The robot may include one or more driven wheels 72. The driven wheels include, but are not limited to, a caster so that the robot can move more stably or stronger on the ground.

The drive-wheel module 71 may include a travel wheel, a drive motor and a control circuit for controlling the drive motor. The drive-wheel module 71 may also be connected to a circuit for measuring the drive current and an odometer. The drive-wheel module 71 is removable and connected to the main body 1 for easy disassembly and maintenance. The drive wheel may have a biased drop-suspension system. The drive wheel is movably fastened, for example, rotatably attached, to the main body 1 and receives a spring offset that is biased downwardly and away from the main body 1. The spring offset allows the drive wheel to maintain contact and traction with the ground with a certain ground force. At the same time the robot's cleaning elements (such as the roller brush, etc.) also contact the ground with a certain pressure.

The forward part 13 of the main body 1 may carry a buffer. When the drive-wheel module 71 drives the robot to travel on the ground during cleaning, the buffer detects one or more events in the travel path of the robot via a sensor system, such as an infrared sensor. The robot may control the drive-wheel module 71 to respond to an event, such as away from an obstacle, by events detected by the buffer, such as an obstacle like a wall.

The control system is provided on the circuit board in the main body 1. The control system may include temporary memory, such as a hard disk, a flash memory, a random-access memory, and a communication-computing processor such as a central processing unit or an application processor. The application processor can draw an instant map of the environment in which the robot is located based on the obstacle information fed back by the LDS and the positioning algorithm, such as SLAM. The distance information and velocity information fed back by the sensor, such as the buffer, the cliff sensor 51, the ultrasonic sensor, the infrared sensor, the magnetometer, the accelerometer, the gyroscope, the odometer and so on, are used to determine the current working state of the sweeping machine. The working state of the sweeping machine may include crossing the threshold, walking on the carpet, at the cliff, above or below stuck, the dust cartridge full, picked up, etc. The application processor gives specific instructions for the next step for different situations. The robot is more in line with the requirements of the owner and provides a better user experience. Furthermore, the control system can plan the most efficient cleaning path and cleaning method based on real-time map information drawn by SLAM, which greatly improves the cleaning efficiency of the robot.

The energy system may include a rechargeable battery, such as a nickel-metal hydride battery or a lithium battery. The rechargeable battery can be coupled to a charging control circuit; a battery pack-charging, temperature-detecting circuit; and a battery-under-voltage monitoring circuit. The charging control circuit, the battery pack-charging, temperature-detecting circuit and the battery-under-voltage monitoring circuit are coupled to the microcontroller control circuit. The host is charged by connecting to the charging pile provided on the side or the lower side of the host. If the exposed charging electrode is dusted, the plastic body around the electrode will melt and deform due to the accumulation of charge during the charging process, and even cause the electrode itself to be deformed and unable to continue to be charged normally.

The human-computer interaction system 9 may include buttons on the host panel, and the buttons are configured to select the function by users. The human-computer interaction system may also include a display screen and/or a light, and/or a speaker. The display, the light and the speaker are configured to show the user the current status of the machine or a function selection. The human-computer interaction system may also include a mobile client application. For the path navigation-type cleaning equipment, the mobile client can show the user the map of the equipment located, as well as the location of the equipment, and can provide users with more rich and user-friendly features.

In order to more clearly describe the behavior of the autonomous cleaning robot, directions are defined as follows. The autonomous cleaning robot can travel on the ground by various combinations of movements of the following three mutually perpendicular axes defined by the main body 1: a front and rear axis X (i.e., the axis in the direction along the forward part 13 and the backward part 14 of the main body 1), a lateral axis Y (i.e., the axis perpendicular to the axis X and in a same plane with the axis X) and a center vertical axis Z (the axis perpendicular to the axis X and the axis Y). The forward direction of the front and rear axis X is defined as "forward", and the backward direction of the front and rear axis X is defined as "backward." The lateral axis Y extends along the axis defined by the center point of the drive-wheel module 71 between the right wheel and the left wheel of the autonomous cleaning robot.

The autonomous cleaning robot can rotate around the Y axis. When the forward part of the autonomous cleaning robot is tilted upward and the backward part is tilted downward, it is defined as "up." When the forward part of the robot is tilted downward and the backward part is tilted upward, it is defined as "down." In addition, the autonomous cleaning robot can rotate around the Z axis. In the forward direction of the robot, when the robot tilts to the right side of the X axis, it is defined as "right turn," and, when the robot tilts to the left side of the X axis, it is defined as "left turn."

The dust cartridge is mounted in a receiving chamber by means of a buckle and handle. When the handle is pulled, the buckle shrinks. When the handle is released, the buckle extends to a groove of the receiving chamber.

The specific structure of the first cleaning subassembly 2 and the main body 1 will be described in detail below.

The first cleaning subassembly 2 is mounted on the main body 1 by a guiding member. When the first cleaning subassembly 2 is mounted on the main body 1, the first cleaning subassembly 2 is movable up and down with respect to the main body 1. That is, a gap exists between the first cleaning subassembly 2 and the main body 1.

In some embodiments, the first cleaning subassembly 2 is provided on the chassis 11 of the main body 1. The chassis 11 is provided with a protrusion structure 113 for mounting the first cleaning subassembly 2. In the embodiments of the present disclosure, the first cleaning subassembly 2 is provided on the chassis 11 at the backward part 14 of the main body 1.

The first cleaning subassembly 2 is mounted to the chassis 11 through a guiding member, and the first cleaning subassembly 2 is in clearance fit with the chassis 11.

As shown in FIGS. 3 to 10, the guiding member may include a first guiding ridge 311 and a first guiding groove 111. The first guiding groove is defined on one of the first cleaning subassembly 2 and the chassis 11. The first guiding ridge 311 is provided on the other one of the first cleaning subassembly 2 and the chassis 11.

Figure 11:
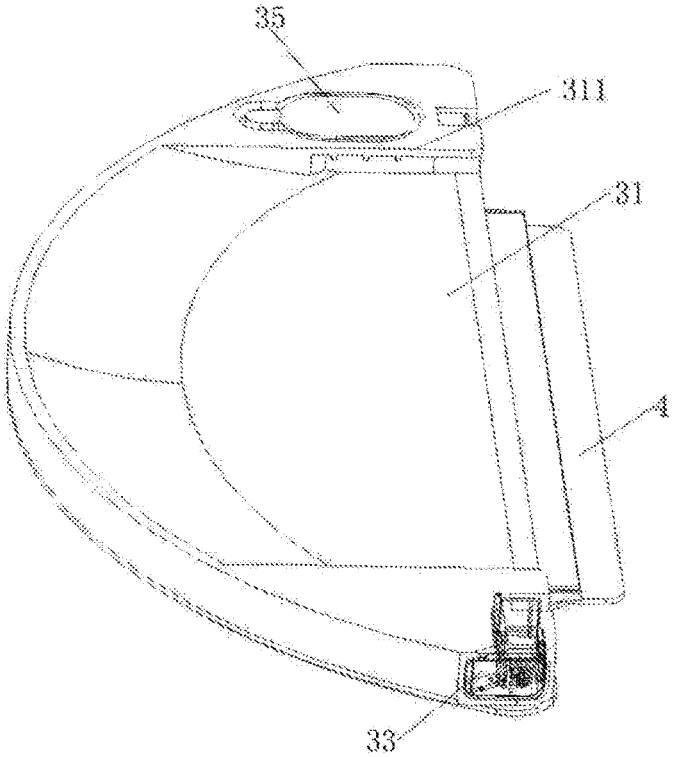
FIG. 11 illustrates a schematic view of a first view of a liquid container of an autonomous cleaning robot, in accordance with embodiments of the present disclosure.
Figure 12:
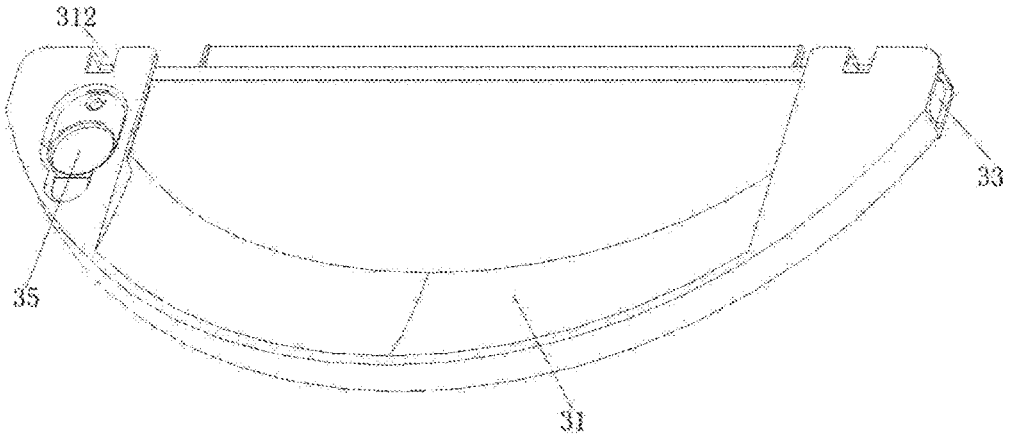
FIG. 12 illustrates a schematic view of a second view of a liquid container of the autonomous cleaning robot, in accordance with embodiments of the present disclosure.

In the illustrated embodiments, the first guiding groove 111 is defined on the side wall of the protrusion structure 113 of the chassis 11. The first guiding ridge 311 is provided on the liquid container 3 of the first cleaning subassembly 2. When the liquid container 3 is engaged with the chassis 11, the first guiding ridge 311 is inserted into the first guiding groove 111 to realize the guiding and stop action. As illustrated in FIG. 11, in order to make way of the protrusion structure 113 on the chassis 11, the liquid container 3 defines a recess.

Preferably, in order to facilitate the installation of the liquid container 3, the thickness of the first guiding ridge 311 is smaller than the width of the first guiding groove 111. Wherein, the width of the first guiding groove 111 refers to the width between the opposite-side walls of the first guiding groove 111, i.e., the vertical distance between the two opposite-side walls when the robot is in the horizontal position. After the first guiding ridge 311 is inserted into the first guiding groove 111, the first guiding ridge 311 has a distance between the opposite-side walls of the first guiding groove 111. A clearance fit structure between the liquid container 3 and the chassis 11 is formed to facilitate the user to install the liquid container 3.

The width of the gap between the liquid container 3 and the chassis 11 can be determined as desired. In the embodiments of the present disclosure, the width of the gap between the liquid container 3 and the chassis 11 is in the range of 1.5 mm to 4 mm. Preferably, the gap between the liquid container 3 and the chassis 11 is 2 mm. The gap provides a space for the insertion action when the user inserts the liquid container 3 into the chassis 11 without turning the robot off. The user can smoothly mount the liquid container 3 to the chassis 11 and is not required to strictly align the liquid container 3 with the chassis 11. The current mopping robot usually requires the user to turn the robot upside down (that is, bottom up) and then install the tank. In this condition, on the one hand, it is inconvenient for the user to use and install, and, on the other hand, if the tank leaks, the water easily leaks into the interior of the robot, causing the robot to be damaged.

In the embodiments of the present disclosure, the first cleaning subassembly 2 is mounted to the main body 1 in the forward direction or the backward direction of the main body 1 and then connected to the main body 1 through a connecting member. The connecting member may include a first connecting member provided on the main body 1 and a second connecting member provided on the first cleaning subassembly 2.

Preferably, in order to facilitate control of the connection and separation of the first cleaning subassembly 2 from the main body 1, the autonomous cleaning robot may further include a connection-control assembly. The connection-control assembly is connected to the first connecting member or the second connecting member and controls the connection and separation of the second connecting member and the first connecting member.

Preferably, the connection-control assembly is provided on the first cleaning subassembly 2.

In the embodiments of the present disclosure, the connecting member is a catching structure. That is, the first connecting member and the second connecting member are engaged. The liquid container 3 is connected to the chassis 11 through the catching structure. The catching structure is not only easy to install, but also reliable. Of course, in other embodiments, the connecting member may be other structures, such as a magnetic structure. The liquid container 3 may be connected to the chassis 11 by other means, such as magnetic connection. Correspondingly, the connection-control assembly may be a catching control system or a magnetic control system, to ensure that users can easily install and remove the liquid container 3.

The details will be described in detail with respect to the specific embodiment in which the liquid container 3 and the chassis 11 are connected by a catching structure.

Figure 7:
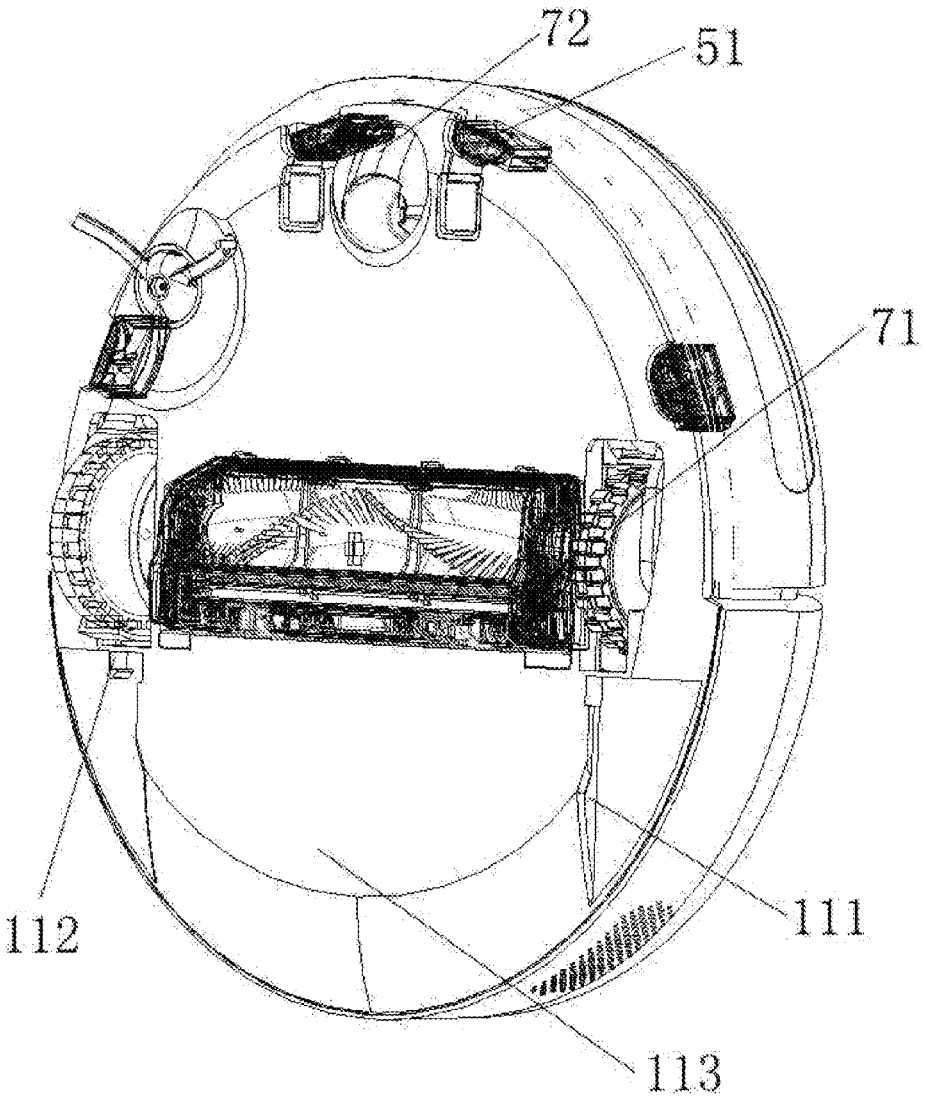
FIG. 7 illustrates a bottom schematic view of a main body of an autonomous cleaning robot, in accordance with embodiments of the present disclosure.
Figure 8:
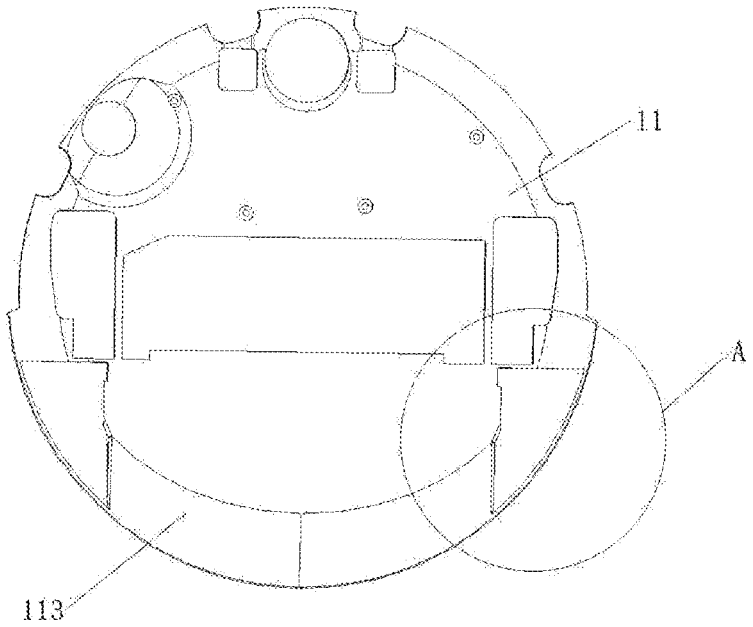
FIG. 8 illustrates a bottom view of a chassis of a main body of an autonomous cleaning robot, in accordance with embodiments of the present disclosure.
Figure 9:
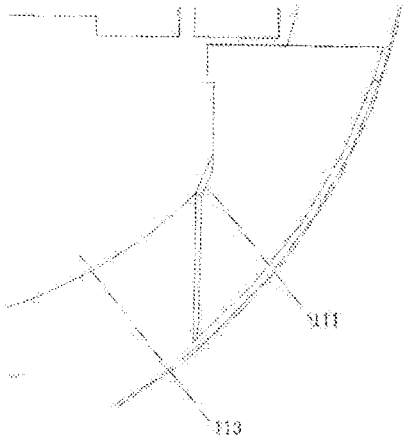
FIG. 9 is a partial enlarged view of A in FIG. 8.
Figure 10:
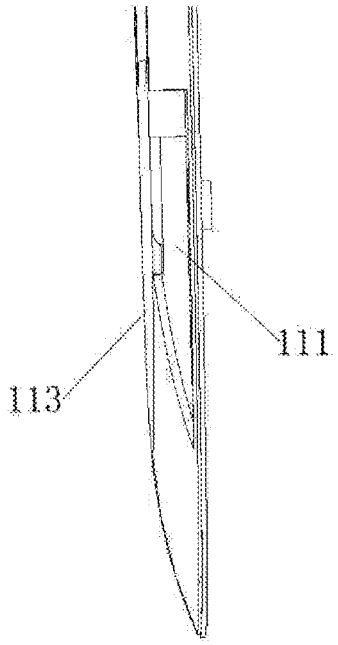
FIG. 10 illustrates a side view of a first guiding groove on the chassis of the main body of an autonomous cleaning robot, in accordance with embodiments of the present disclosure.
Figure 18:
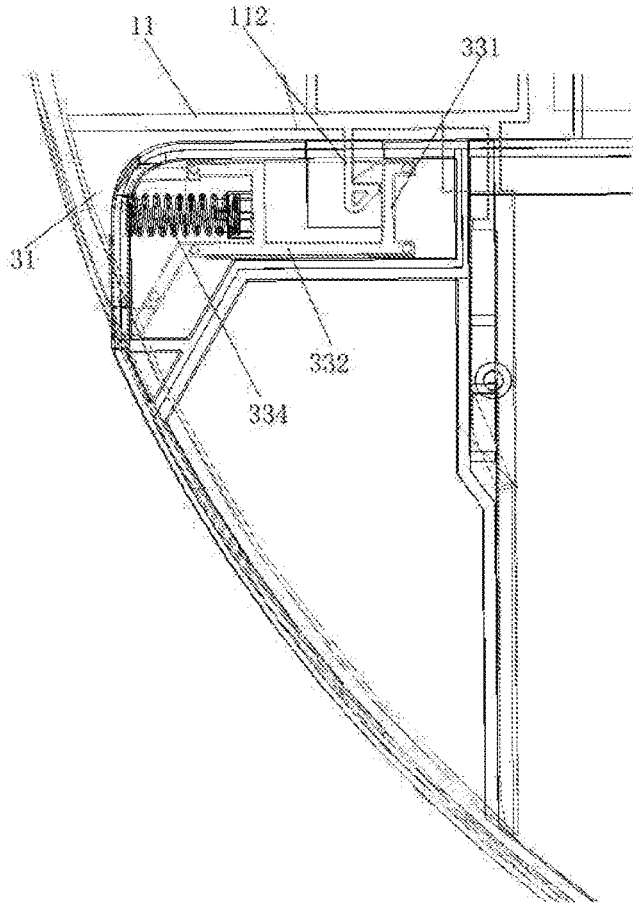
FIG. 18 illustrates a schematic view of the structure of the engagement-control member, the first-buckle and the second-buckle fit of the autonomous cleaning robot, in accordance with embodiments of the present disclosure.

Referring to FIG. 7, the chassis 11 is provided with a first connecting member. The first connecting member may be a first buckle 112 or an electromagnet or a magnetic conductor. Taking the first buckle as an example, the first buckle 112 is configured to couple with the liquid container 3 to realize the fixing of the liquid container 3. Referring to FIGS. 11 to 17, the liquid container 3 is provided with the second connecting member. The connecting member may be a second buckle 331 cooperated with the first buckle 112 or an electromagnet or a magnetic conductor. The first buckle 112 and the second buckle 331 cooperatively constitute the connecting member. The second buckle 331 defines a stop position and a retracting position. As shown in FIG. 18, at the stop position, the second buckle 331 and the first buckle 112 are stopped from each other, and the liquid container 3 is connected to the chassis 11. At the retracting position, the second buckle 331 is separated from the first buckle 112, and the liquid container 3 can be detached from the chassis 11. The connection-control assembly may be provided in the liquid container 3 or may be provided in the main body 1. For example, the connection-control assembly is provided in the container body of the liquid container 3 or may be provided in the chassis 11 of the machine body 1. When the connection-control assembly is provided in the main body 1, the connection-control assembly is connected to the first connecting member and controls the movement of the first connecting member to affect engagement or separation of the first connecting member with the second connecting member. When the connection-control assembly is provided in the liquid container 3, the connection-control assembly is connected to the second connecting member and controls the movement of the second connecting member to affect engagement or separation of the first connecting member with the second connecting member.

Next, an example in which the connection-control assembly is provided in the liquid container 3 will be described.

In order to control the engagement and separation of the first buckle and the second buckle 331, the connection-control assembly may include an engagement-control subassembly 33. The engagement-control subassembly 33 controls the position of the second buckle 331 to make the second buckle 331 engaged with or separated from the first buckle 112. In use, the user can control the engagement-control subassembly 33 to control the position of the second buckle 331. That is, the liquid container 3 and the chassis 11 may be engaged or separated to facilitate the loading or removal of the liquid container 3.

In some embodiments, an upper cover 31 of the liquid container 3 defines a groove for mounting the engagement-control subassembly 33 and the second buckle 331. The engagement-control subassembly 33 is provided in the upper cover 31. The upper cover 31 defines an opening for the first connecting member inserting thereinto and cooperating with the second connecting member.

In addition, the liquid container 3 may include the container body, the upper cover 31, and a lower cover 32. The container case defines a liquid-accommodation space for accommodating the liquid. In the embodiments of the present disclosure, the liquid placed in the liquid container is water. Of course, in other embodiments, the liquid container may contain any other cleaning solution as required.

The connection-control assembly is provided in the main body 1. The main body 1 defines a recess for receiving the engagement-control subassembly 33 and the first connecting member. The main body further defines an opening for the second connecting member inserting thereinto and cooperating with the first connecting member.

As illustrated in FIGS. 14 to 17, one of the engagement-control assemblies may include a mounting frame 332, an operating member 333 and an elastic member 334.

The second buckle 331 is fixedly mounted on the mounting frame. The mounting frame is movably disposed within the container body and can drive the second buckle 331 to the stop position or retracting position. The operating member is mounted on the mounting frame and is integrally formed with the mounting frame 332. When the user presses the operating member 333, the operating member 333 drives the mounting frame 332 and the second buckle 331 thereon to move together.

The elastic member 334 is provided between the operating member 333 and the container body of the liquid container 3 to ensure that the second buckle 331 can be back to the stop position after the pressing force is lost, thereby ensuring that the liquid container 3 can connect with the chassis 11 reliably. The elastic member 334 may be a structure that can provide an elastic force, such as a spring, an elastic rubber, or the like. A first end of the elastic member abuts against the operating member or the mounting frame. The second end of the elastic member abuts against the container body. And the direction of expansion and contraction of the elastic member coincides with the moving direction of the mounting frame. In a case wherein there is no press, the elastic force of the elastic member 334 causes the second buckle 331 to be held in the stop position. When the user needs to remove the liquid container 3, the user presses the operating member 333 to move the second buckle 331 to the retracting position, the first buckle 112 and the second buckle 331 on the chassis 11 are separated from the stopper, and the liquid container 3 can then be successfully removed.

Figure 13:
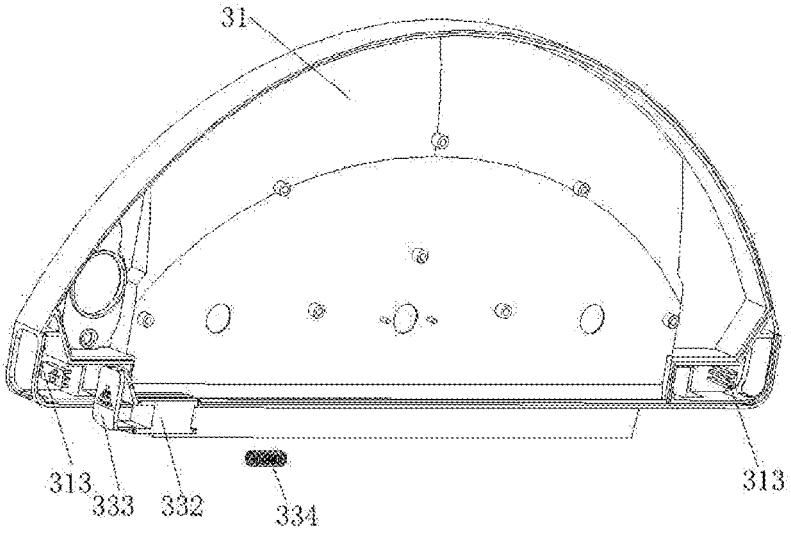
FIG. 13 illustrates a schematic view of a first view of an upper cover and an engagement-control subassembly of a liquid container of an autonomous cleaning robot, in accordance with embodiments of the present disclosure.

As illustrated in FIG. 13, a stop protrusion 313 is provided on the container body of the liquid container, and the mounting frame 332 defines a hole for the stop protrusion inserting thereinto. The stroke of the mounting frame 332 can be defined by fitting the stopper projection 313 and the hole wall 332*a* of the hole. Therefore, the mounting frame 332 can be limited, and the mounting member 332 is prevented from falling off the liquid container 3 without the pressing force produced by the elastic force of the elastic member 334.

In some embodiments, the first end of the elastic member 334 abuts against the operating member 333. The second end of the elastic member abuts against the stop protrusion 313. The operating member 333 and the stop protrusion 313 are provided with a cross-convex post for mounting the elastic member 334.

Figure 3:
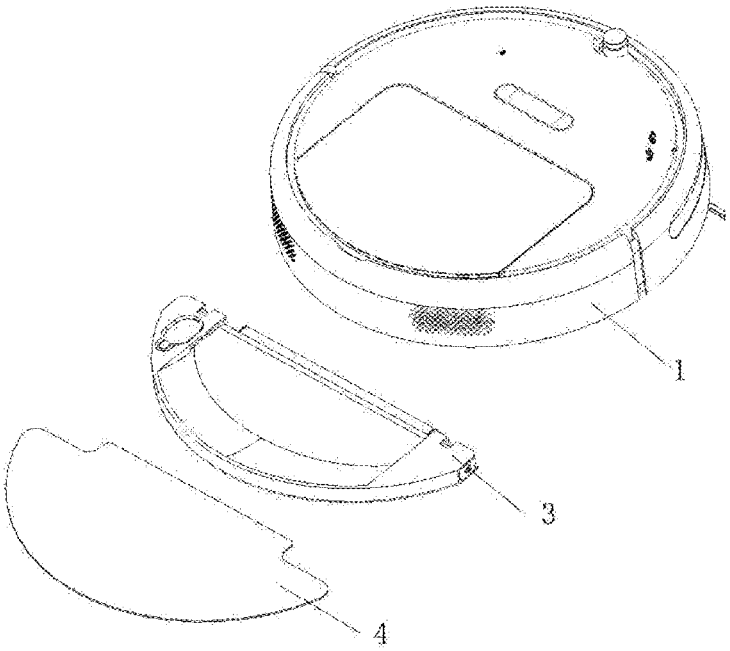
FIG. 3 illustrates a schematic view of a first view a main body and a first cleaning subassembly of an autonomous cleaning robot, in accordance with embodiments of the present disclosure.
Figure 4:
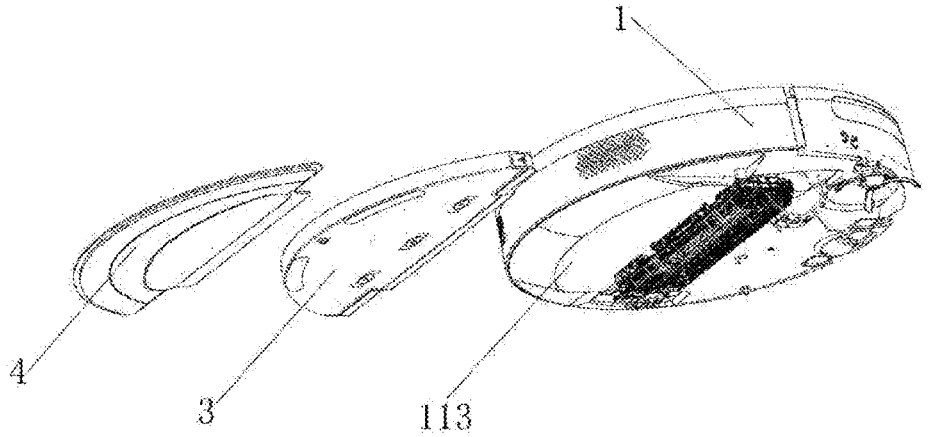
FIG. 4 illustrates a schematic view of a second view of a main body and a first cleaning subassembly of an autonomous cleaning robot, in accordance with embodiments of the present disclosure.
Figure 5:
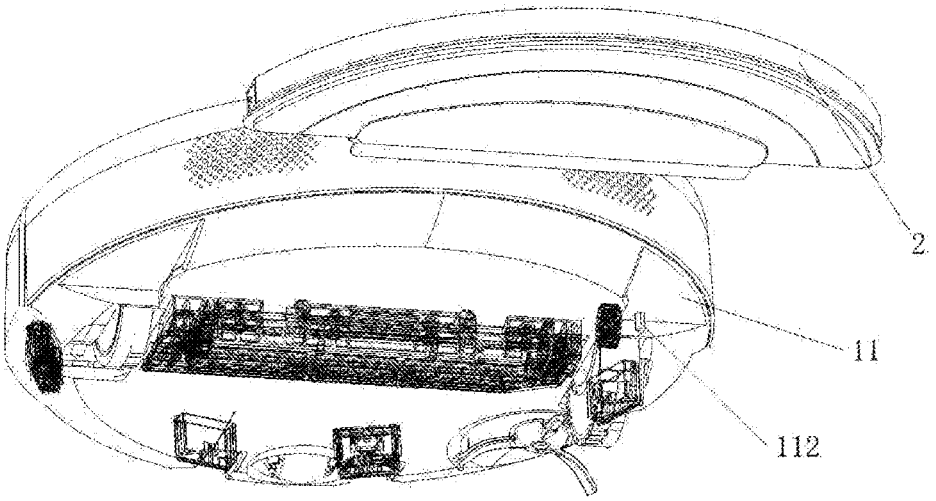
FIG. 5 illustrates a schematic view of a third view of a main body and a first cleaning subassembly of an autonomous cleaning robot, in accordance with embodiments of the present disclosure.
Figure 6:
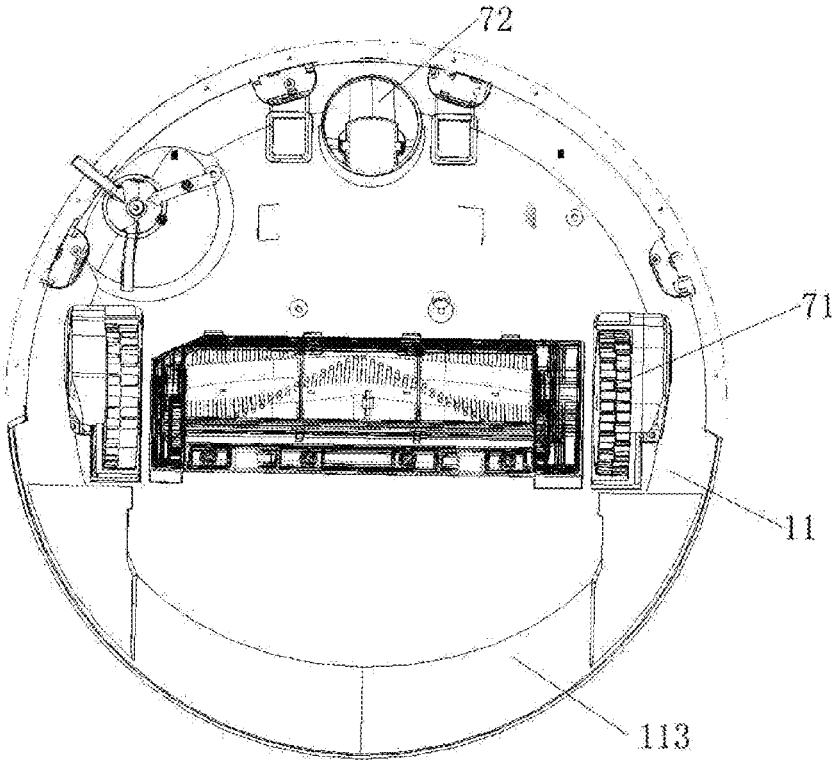
FIG. 6 illustrates a bottom view of a main body of an autonomous cleaning robot, in accordance with embodiments of the present disclosure.

The specific process of loading the liquid container 3 into the chassis 11 is as follows:

As illustrated in FIG. 3 and FIG. 4, the liquid container 3 is inserted into the rear portion of the chassis 11 along the first guiding groove 111 on the chassis 11 to form an overall appearance of the autonomous cleaning robot. The chassis 11 of the robot has a first connecting portion. In some specific embodiments, the first connecting may be a hook. The hook can connect with a second connection portion of the liquid container. In other specific embodiments, the second connection portion may be a buckle so that the liquid container can be fixed to the bottom of the main body 1. The first guiding groove 111 may be a U-shaped groove and can be slid with the first guiding ridge 311 on the liquid container to guide the liquid container 3 to slide on the chassis 11.

In the natural state, the second buckle 331 is in the groove of the liquid container 3. When the liquid container 3 is slid into the mating position along the first guiding groove 111 on the chassis 11, the first buckle 112 (hook) on the chassis 11 abuts against the second buckle 331. The second buckle 331 moves toward a region other than the groove, and the first buckle 112 (hook) can slide into the groove along the slope on the second buckle 331 when the force is applied to a certain extent so that the second buckle 331 can engage with the first buckle 112 (hook) to effect fixing the liquid container 3 on the chassis 11. After the liquid container 3 is mounted on the chassis 11, the operating member 333 of the engagement-control member 33 can be pressed against the spring resistance, and the second buckle 331 may be retracted in the liquid container 3 by the force transmission. Then the engagement between the first buckle 112 (hook) and the second buckle 331 may disappear, and the liquid container can be pulled out from the backward direction of main body 1 to realize the unloading of the liquid container 3.

In another engagement-control subassembly (not shown), the engagement-control subassembly may include a connecting rod 381, a spring 382, a toggle piece 383, and a buckle 384. The buckle 384 is used to cooperate with the first buckle 112 to affect the connection of the liquid container 3 to the chassis 11. The connecting rod 381 is provided in the liquid container 3. The first end of the connecting rod 381 is provided with the buckle 384, and the second end of the connecting rod 381 is provided with the toggle piece 383. The toggle piece 383 is rotatable and provided in the liquid container 3. A first end of the toggle piece 383 is fixed with the spring 382, and a second end of the toggle piece 383 is an operating end. The spring 382 is connected between the toggle piece 383 and the liquid container 3. The schematic view of the engagement-control subassembly is shown in FIG. 19.

It should be noted that one or more connection-control assemblies may be provided on the liquid container 3. Each connection-control assembly may include an engagement-control subassembly 33. When the liquid container 3 includes two or more connection-control assemblies, the structure of the engagement-control subassembly 33 of each connection-control assembly may be the same or different.

Figure 14:
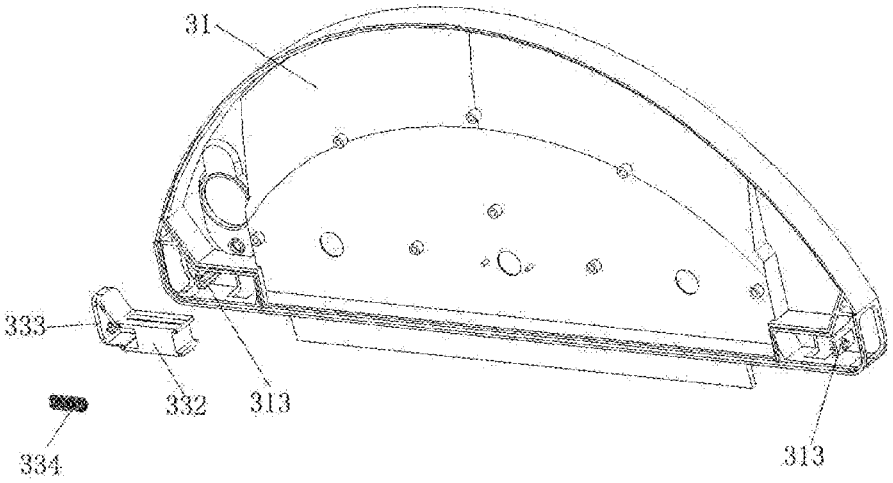
FIG. 14 illustrates an explosion view of a second view of an upper cover and an engagement-control subassembly of a liquid container of an autonomous cleaning robot, in accordance with embodiments of the present disclosure.
Figure 15:
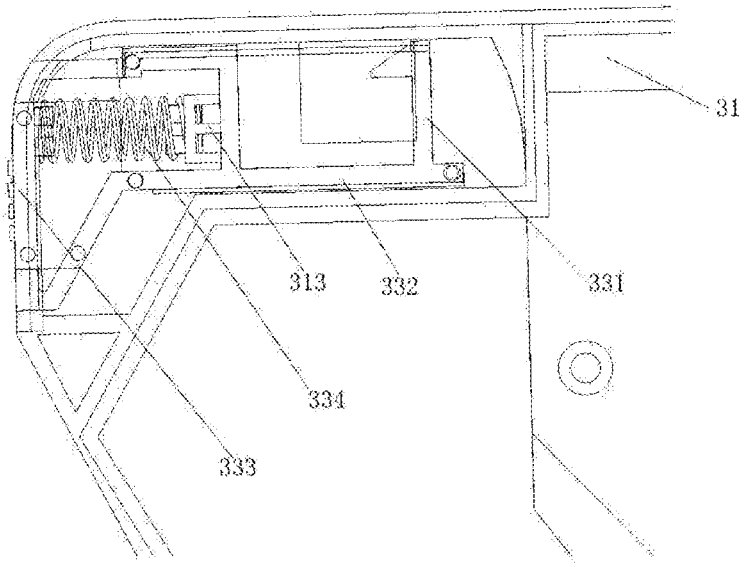
FIG. 15 illustrates a schematic view of the upper cover and the engagement-control subassembly fit of a liquid container of an autonomous cleaning robot, in accordance with embodiments of the present disclosure.
Figure 16:
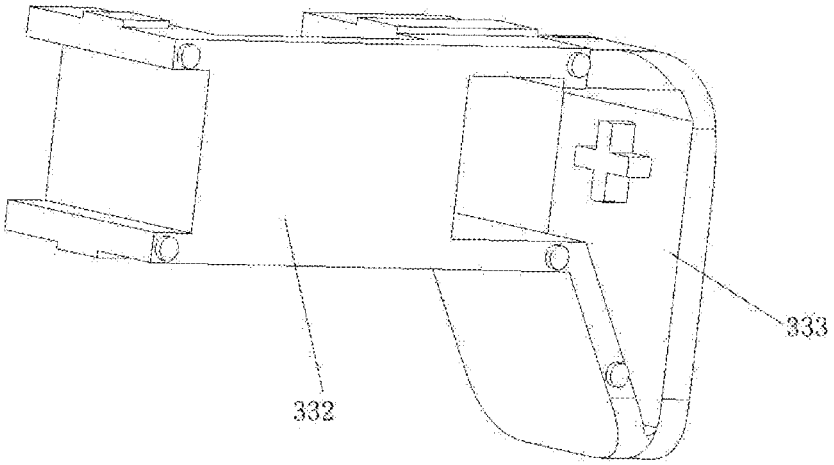
FIG. 16 illustrates a schematic view of a first view of a mounting frame of an engagement-control subassembly of an autonomous cleaning robot, in accordance with embodiments of the present disclosure.
Figure 17:
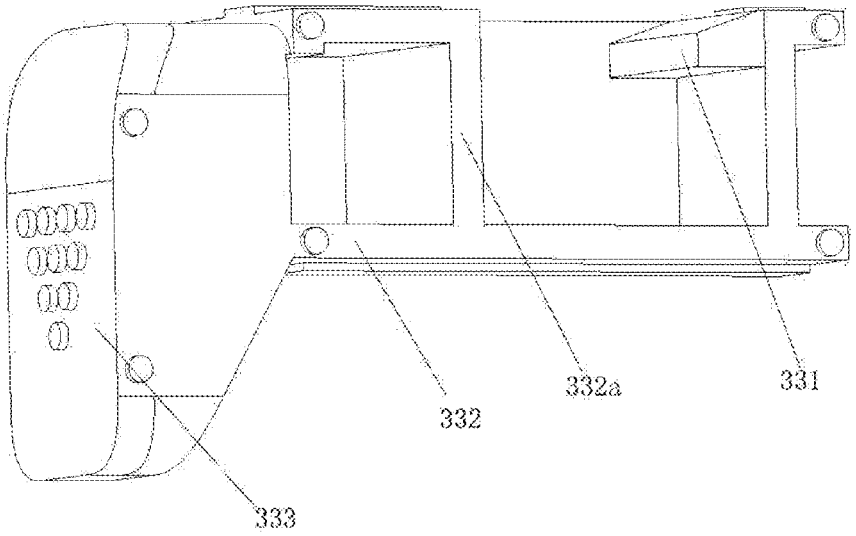
FIG. 17 illustrates a schematic view of a second view of a mounting frame of an engagement-control subassembly of an autonomous cleaning robot, in accordance with embodiments of the present disclosure.
Figure 19:
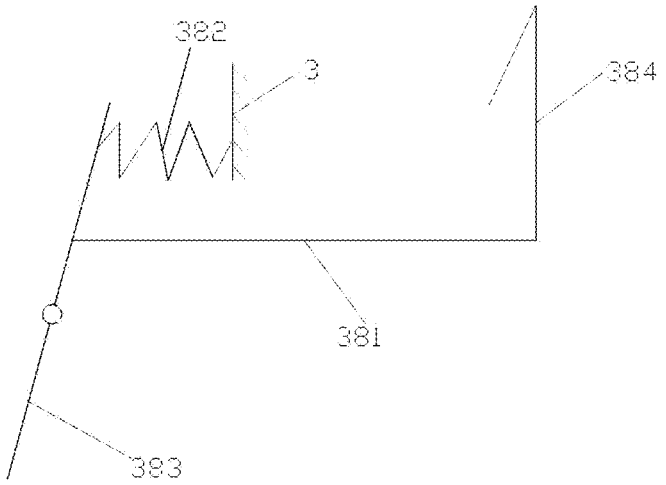
FIG. 19 illustrates a schematic view of another engagement-control subassembly of an autonomous cleaning robot, in accordance with embodiments of the present disclosure.
Figure 20:
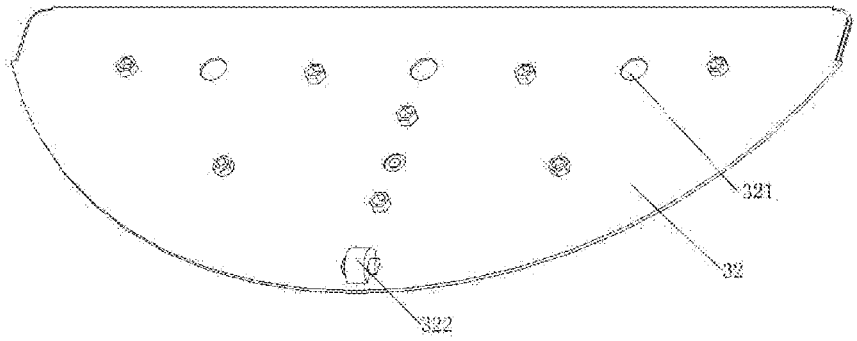
FIG. 20 illustrates a schematic view of a first view of a lower cover of a liquid container of an autonomous cleaning robot, in accordance with embodiments of the present disclosure.
Figure 21:
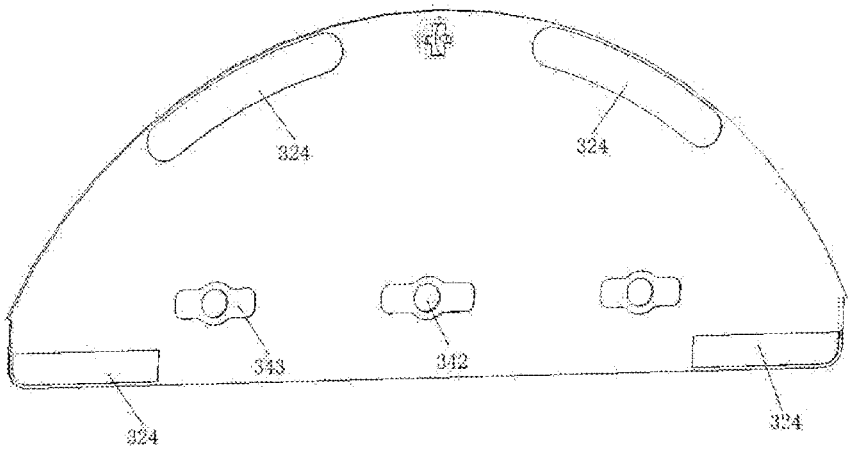
FIG. 21 illustrates a schematic view of a second view of a lower cover of a liquid container of an autonomous cleaning robot, in accordance with embodiments of the present disclosure.
Figure 22:
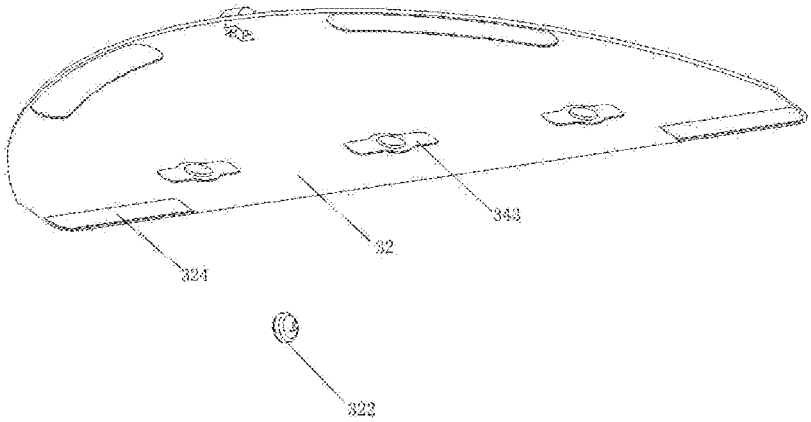
FIG. 22 illustrates a schematic view of a third view of a lower cover of a liquid container of an autonomous cleaning robot, in accordance with embodiments of the present disclosure.
Figure 23:
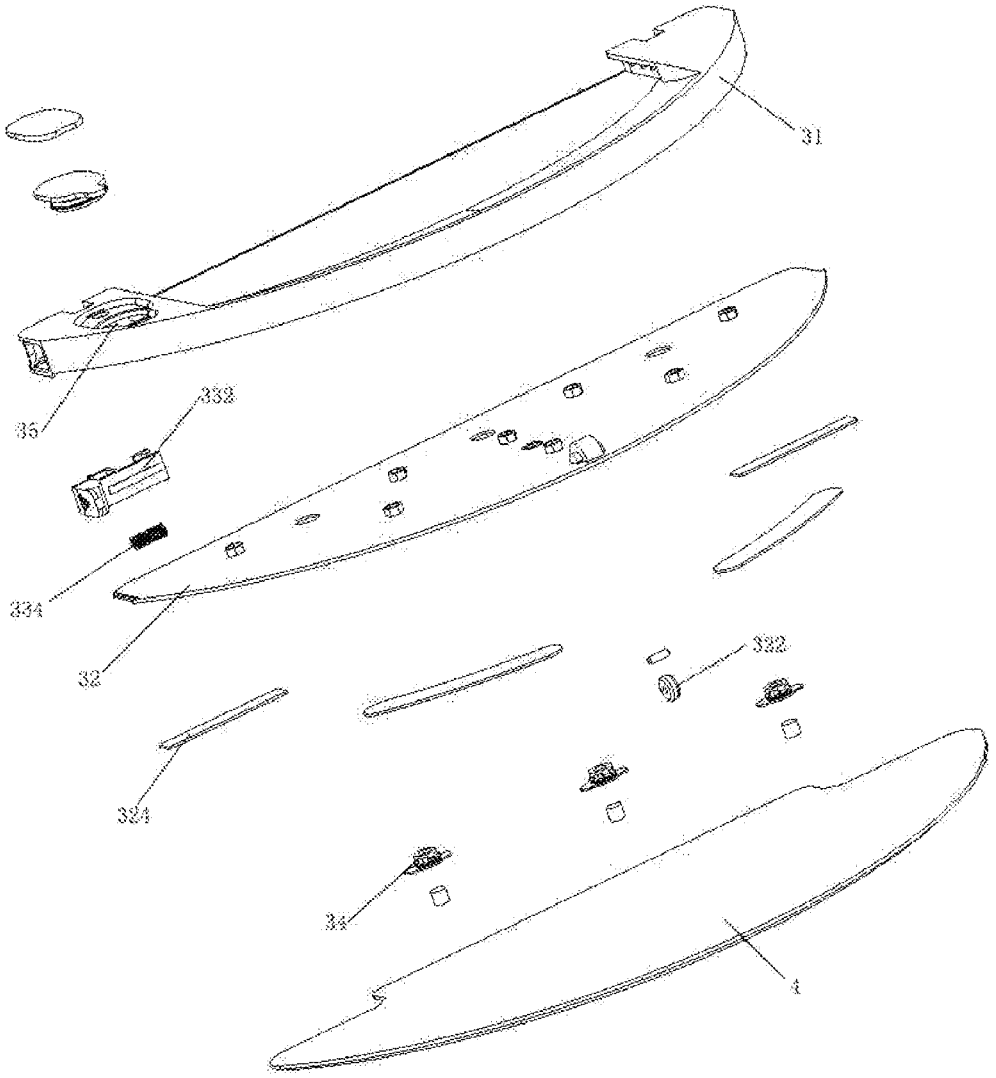
FIG. 23 illustrates a schematic view of a liquid container of an autonomous cleaning robot, in accordance with embodiments of the present disclosure.

When the liquid container 3 includes two connection-control assemblies, the engagement-control subassembly in one is the engagement-control subassembly 33, as shown in FIG. 14, and the engagement-control subassembly in the other is the engagement-control subassembly 33, as shown in FIG. 19.

As shown in FIGS. 20 to 23, the upper cover 31 of the liquid container 3 is further provided with a water injection port 35 for injecting liquid into the liquid-accommodation space. The water injection port 35 is provided with a water injection plug and a water injection cap to seal the water injection port 35.

The lower cover 32 of the liquid container 3 is also provided with a water outlet 321, the water outlet 321 communicates with the liquid accommodation space, and the outlet 321 is removable and provided with a water outlet filter 34 for controlling the amount of water.

On the one hand, the lower cover 32 cooperates with the upper cover 31 to form the containing case body and surrounds the liquid accommodation space for accommodating the liquid. On the other hand, the lower cover 32 is configured to mount the cleaning cloth 4. A plurality of adhesive structures 324 are fixed to one side of the lower cover 32, far away from the upper cover 31. The cleaning cloth 4 is laid on the side of the lower cover 32, far away from the upper cover 31, and is attached to the lower cover 32 by the adhesive structure. The adhesive structure 324 may be a double-sided adhesive or a Velcro. In order to facilitate the replacement of the cleaning cloth 4, preferably the adhesive structure 324 is a Velcro.

Figure 27:
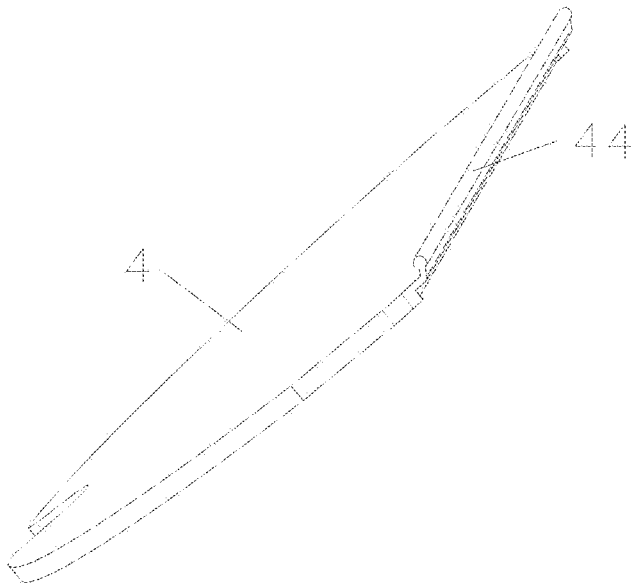
FIG. 27 illustrates a schematic view of a cleaning cloth of an autonomous cleaning robot, in accordance with embodiments of the present disclosure.
Figure 28:
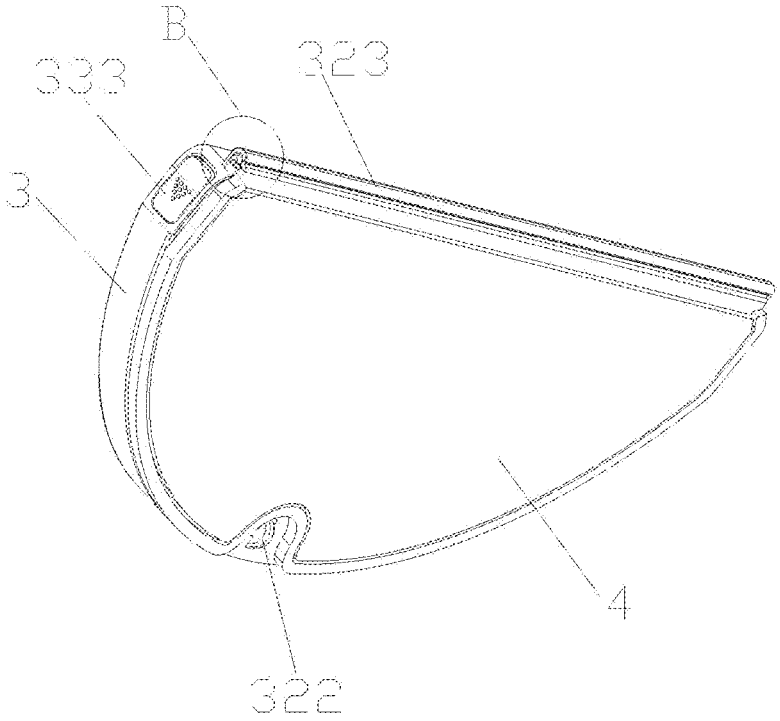
FIG. 28 illustrates a schematic view of a liquid container and a cleaning-cloth fit of an autonomous cleaning robot, in accordance with embodiments of the present disclosure.
Figure 29:
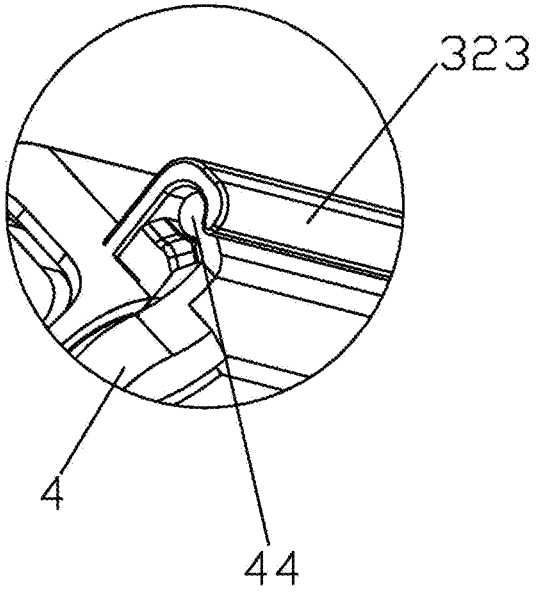
FIG. 29 is a partial enlarged view of B in FIG. 28.

As shown in FIGS. 27 to 29, more preferably the edge of the cleaning cloth 4 is fixed to ensure that the direction and position of the cleaning cloth 4 are correct, and the cleaning cloth 4 is prevented from being tilted and affecting the cleaning effect. If using a paste method to fix the cleaning cloth 4, the installation direction of the edge may not be limited and the correct installation of the cleaning cloth 4 cannot be guaranteed. For example, if the cleaning cloth is slanted relative to the tank, the cleaning effect will be seriously affected. The cleaning cloth 4 is provided with a first guide portion, and the liquid container 3 is provided with a second guide portion, and the first guide portion and the second guide portion can be engaged with each other so that the cleaning cloth 4 is mounted on the liquid container 3. The first guide portion may be a guiding groove, and the second guide portion may be a guide rod that engages with the guiding groove.

In some embodiments, a guiding strip 44 is fixedly provided on the side of the cleaning cloth 4, and a mounting groove 323 is provided in the liquid container 3. The guiding strip 44 penetrates the mounting groove 323 and defines the side of the cleaning cloth 4 on the liquid container 3.

The guiding strip 44 may be a plastic rod or a steel rod having a certain rigidity, or it may be a flexible strip. The cross-sectional shape of the guiding strip 44 may be circular or other noncircular shape. The cross-sectional shape of the mounting groove 323 on the liquid container 3 is a C-shape or a shape like the C-shape, but the guiding strip 44 must be able to be accommodated and defined. The opening (i.e., the opening of the C-shape) of the mounting groove 323 for the cleaning cloth 4 extending is directed downward. One end of the mounting groove 323 is an extending end (the end has no stop structure, which extends into the guiding strip 44) and the other end is a stop end (the end has a stop structure to prevent the guiding strip 44 from coming out of the end). In other words, one end of the mounting groove 323 is closed and the other end is open. The tail portion of the cleaning cloth 4 is fixed to the liquid container 3 by the guiding strip 44 and the mounting groove 323 to improve the fixing stability and prevent the cleaning cloth 4 from falling off. The guiding strip 44 and the mounting groove 323 are in the liquid container 3 and in the forward direction thereof. If the guiding strip 44 is mounted first and then the cleaning cloth 4 is adhered to the Velcro, the cleaning cloth can be installed correctly.

Figure 26:
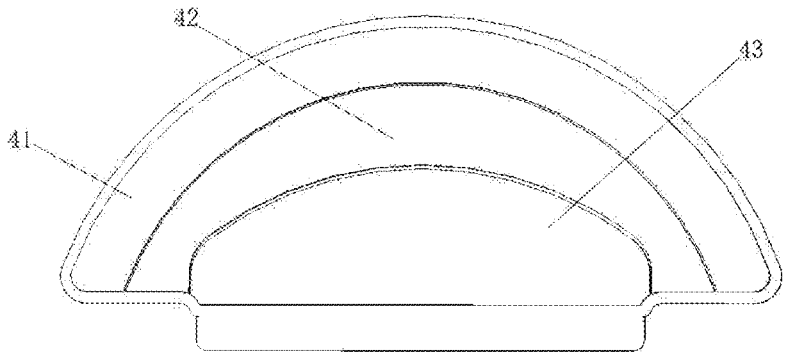
FIG. 26 illustrates a schematic view of a cleaning cloth of an autonomous cleaning robot, in accordance with embodiments of the present disclosure.

As illustrated in FIG. 26, the cleaning cloth 4 may be a cleaning cloth made of the same material or a composite cleaning cloth with different parts thereof made of different materials. In the embodiments of the present disclosure, the cleaning cloth is a composite cleaning cloth. The main body of the cleaning cloth is substantially semicircular. An inner layer 43 of the cleaning cloth is a water-seepage area with high permeability material. A middle layer 42 of the cleaning cloth is a decontamination area with a harder material and used to scrape off the harder material on the ground. An outer layer 41 of the cleaning cloth is a water-absorption area with better water-absorption material used to absorb the water on the bottom surface and remove the water stains so that the cleaning efficiency is improved. The guiding strip 44 is provided on a semicircular straight-line segment.

The liquid in the liquid-accommodating space may flow out of the lower cover 32 via the water outlet 321 and wet the cleaning cloth 4.

In the embodiments of the present disclosure, a filter structure provided in the water outlet 321 controls the amount of water discharged from the water outlet 321. Compared with a water-seepage cloth arranged in the water tank, with one end arranged in the water-storage space and the other end arranged at the outlet, guiding the water in the water tank to the outlet through capillary action using the filter structure to control the water discharged, can solve the problem of the water flow rate that is not easy to control with the water-seepage cloth. Because the water-seepage cloth needs to be completely set in the container case body, the replacement of the water-seepage cloth is inconvenient and costly, and the water tank is required to be disassembled. The filter structure is removable provided in the outlet 321 for easier replacement. By selecting a filter structure with different material, the amount of the water discharged can be controlled, and the needs of users can be better met.

Figure 24:
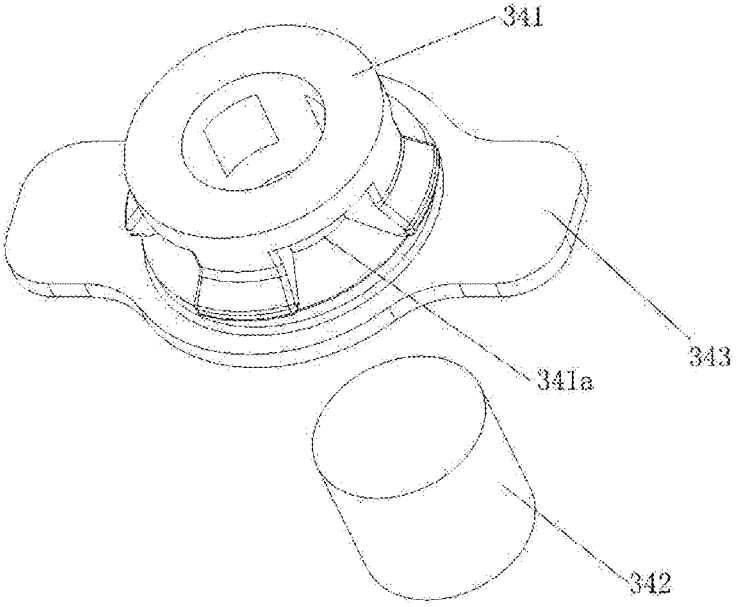
FIG. 24 illustrates a schematic view of a first view of a water outlet filter of an autonomous cleaning robot, in accordance with embodiments of the present disclosure.
Figure 25:
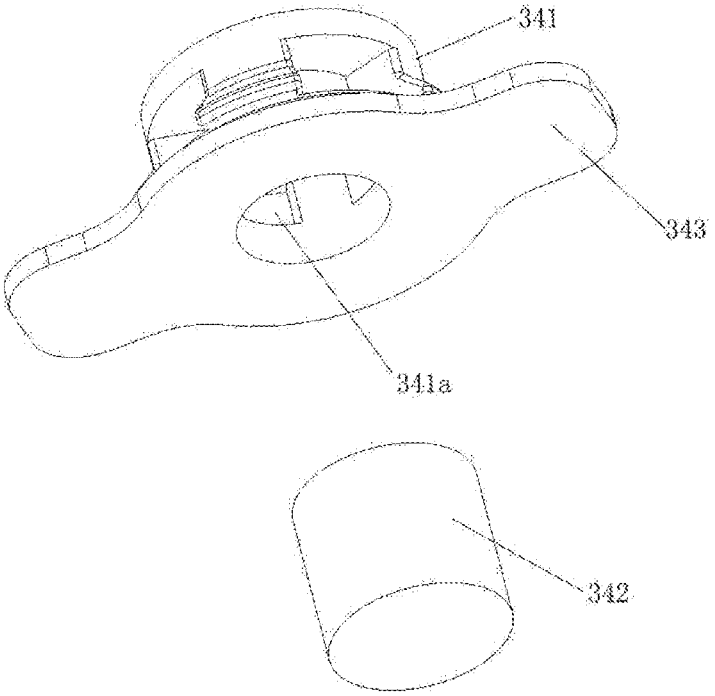
FIG. 25 illustrates a schematic view of a second view of a water outlet filter of an autonomous cleaning robot, in accordance with embodiments of the present disclosure.

In the embodiments of the present disclosure, the filter structure may be the water outlet filter 34. As shown in FIGS. 24 and 25, the water outlet filter 34 may include a filter mounting frame 341 and a filter core 342. The filter mounting frame 341 is removable mounted in the water outlet 321 of the lower cover 32, and the filter mounting frame 341 defines a receiving hole for accommodating the filter core 342. The filter core 342 is filled in the receiving hole. The filter mounting frame 341 defines a water inlet 341*a*, and the water inlet 341*a* is communicated with the receiving hole and the liquid-accommodation space.

After the filter mounting frame 341 is mounted on the water outlet 321 of the lower cover 32, the amount of water discharged can be controlled. Due to the filter mounting frame 341 being inserted into the water outlet 321 from the outside of the lower cover 32 (away from the side of the upper cover 31), the water outlet filter 34 can be replaced without disassembling the container body, making replacement of the water control filter easier. The control of the amount of water discharged only needs to select the filter core 342 with different permeability to make the control of the amount of water discharged more accurate, ensuring the cleaning effect.

Of course, in other embodiments the water outlet filter 34 may only include the filter core 342, as long as the amount of water discharged can be controlled.

Preferably, the number of the water outlet filters 34 is two or more, and each water outlet filter 34 corresponds to a water outlet 321. The number of the water outlet filters 34 may be appropriately selected depending on the area of the cleaning cloth 4 and the required humidity. More preferably, the number of the water control filters 34 is two, and the distance between the two is 10 mm to 350 mm to ensure uniform wetting of the cleaning cloth 4. More preferably, the distance between the two is 80 mm to 90 mm.

Preferably, the water outlet filter 34 further may include a stop gasket 343 (which may be made of a rubber material). The stop gasket 343 is fixed to one end of the filter mounting frame 341, far away from the upper cover 31. A side of the lower cover 32, far away from the upper cover 31, defines a recess for receiving the stop gasket 343. On the one hand, the stop gasket 343 can prevent the liquid from flowing out of the gap between the water outlet and the water outlet filter 34, and, on the other hand, an operation position can be provided for easily removing the water outlet filter 34. The water outlet filter 34 is used to control the amount of water discharged, making the replacement more convenient. And, according to the needs in different environments, the filter core 342 with different materials makes the amount of water discharged controllable, and is a user-friendly choice.

Preferably, in order to improve the climbing and obstacle-crossing capability of the autonomous cleaning robot and enable the autonomous cleaning robot to adapt to more environments, an obstacle-assisting structure is provided on the bottom of the liquid container 3. The obstacle-assisting structure can assist the drive-wheel module 71 of the autonomous cleaning robot when the autonomous cleaning robot is climbing or stepping and provide support for the autonomous cleaning robot in the liquid container 3 to enhance the climbing and obstacle-crossing capability.

Preferably, the obstacle-assisting structure is an obstacle-assisting wheel for crossing obstacles. The obstacle-assisting wheel 322 is rotatably mounted on the liquid container 3. In some embodiments, the lower cover 32 of the liquid container 3 is provided with the obstacle-assisting wheel 322, and the obstacle-assisting wheel 322 is rotatably mounted on the lower cover 32. The cleaning cloth defines an opening at the position corresponding to the obstacle-assisting wheel 322 to avoid the obstacle-assisting wheel 322 so that the obstacle-assisting wheel 322 can be in contact with the ground when necessary.

Correspondingly, the cleaning cloth is provided with a notch so that the obstacle-assisting wheel 322 can be in contact with the ground. When the autonomous cleaning robot is moved on a horizontal ground, the obstacle-assisting wheel 322 is not in contact with the ground. When the autonomous cleaning robot is tilted on a slope or climbing step, the obstacle-assisting wheel 322 is in contact with the ground to form a sliding support point to prevent the main body 1 from getting stuck and achieve obstacle crossing. The height of the climbing step of the autonomous cleaning robot can be determined as needed, such as a height of the climbing step is 17 mm, 19 mm, or higher.

The autonomous cleaning robot of the present disclosure has the following effects:

The connection mode between the liquid container and the main body is the buckle and groove connection. The liquid container is provided with a mounting and connecting structure that can horizontally load the liquid container into the main body, so that there is no need to turn the main body upside down. The liquid container can be directly inserted horizontally into the chassis of the autonomous cleaning robot, which greatly facilitates the user to install and disassemble it.

The connection mode between the liquid container and the main body is the clearance fit. On the one hand, it is more convenient for users to install (if the gap is too small, the liquid container can be inserted only when the gap is in precise alignment, which will cause inconvenience for users. If the gap is large enough, the liquid container can be loaded even if the liquid container is inserted with a certain angle). On the other hand, the ability of the autonomous cleaning robot to cross obstacles can be improved and getting stuck can be prevented when the autonomous cleaning robot encounters obstacles. When the autonomous cleaning robot encounters an obstacle, the liquid container can move up or down to cross the obstacle.

The bottom of the liquid container is provided with the obstacle-assisting wheel. The obstacle-assisting wheel protrudes from the cleaning cloth and contacts the ground when the autonomous cleaning robot crosses the obstacle. Because the liquid container is in clearance fit with the main body and provided with the obstacle-assisting wheel, the ability to cross the obstacle has greatly improved.

The middle of the liquid container is recessed. Both sides of the liquid container may serve as water storage departments, but also as installation departments, killing two birds with one stone.

The autonomous cleaning robot controls the effluent by way of the water control filter instead of the water-seepage cloth. The water control filter is more convenient to replace, and the effluent can be adjusted.

The obstacle-assisting wheel is mounted on the liquid container directly, so that the ability to cross the obstacle of the autonomous cleaning robot will improve.

While the present disclosure has been described in terms of what is presently considered to be the most practical and preferred embodiments, it is to be understood that the present disclosure does not need to be limited to the disclosed embodiment. On the contrary, it is intended to cover various modifications and similar arrangements included within the spirit and scope of the appended claims, which are to be accorded with the broadest interpretation to encompass all such modifications and similar structures.

What is claimed is:

1. An autonomous cleaning robot, comprising:

a main body;

a cleaning assembly, the cleaning assembly mounting on the main body, the cleaning assembly comprising a first cleaning subassembly removable and mounted on the main body, the first cleaning subassembly being removable and connected to the main body through a connecting member, the first cleaning subassembly being moved in the forward direction or the backward direction of the main body when the first cleaning subassembly is loaded into or removed from the main body, and the first cleaning subassembly comprising a liquid container; and an obstacle-assisting wheel, rotatably mounted on the liquid container.

2. The autonomous cleaning robot as claimed in claim 1, wherein the connecting member comprises a first connecting member and a second connecting member, the main body is provided with the first connecting member, and the first cleaning subassembly is provided with the second connecting member.

3. The autonomous cleaning robot as claimed in claim 2, wherein the first connecting member comprises a first buckle, and the first buckle is fixed on the main body.

4. The autonomous cleaning robot as claimed in claim 2, wherein the autonomous cleaning robot further comprises a connection-control assembly, the connection-control assembly is connected to the first connecting member or the second connecting member, and the connection-control assembly is configured to control the connection and separation between the second connecting member and the first connecting member.

5. The autonomous cleaning robot as claimed in claim 4, wherein the liquid container comprises a container body, and the connection-control assembly is provided on the container body and is connected to the second connecting member.

6. The autonomous cleaning robot as claimed in claim 5, wherein the second connecting member comprises a second buckle, and the second buckle is provided on the container body by the connection-control assembly.

7. The autonomous cleaning robot as claimed in claim 5, wherein the connection-control assembly comprises an engagement-control subassembly, the engagement-control subassembly is provided in the main body or the container body, the engagement-control subassembly drives the first connecting member or the second connecting member to move within the main body or the container body to be connected or separated from the second connecting member or the first connecting member.

8. The autonomous cleaning robot as claimed in claim 7, wherein the container body defines a recess for receiving the engagement-control subassembly and the second connecting member, the container body further defines an opening, and the first connecting member is inserted into the opening and cooperated with the second connecting member; or the main body defines a recess for receiving the engagement-control subassembly and the first connecting member, the main body further defines an opening, and the second connecting member is inserted into the opening and cooperated with the first connecting member.

9. The autonomous cleaning robot as claimed in claim 7, wherein the liquid container is provided with at least two connection-control assemblies, and each connection-control assembly comprises an engagement-control subassembly, or the main body is provided with at least two connection-control assemblies, and each connection-control assembly comprises an engagement-control subassembly.

10. The autonomous cleaning robot as claimed in claim 9, wherein the at least two connection-control assemblies on the liquid container or the main body are the same, or the at least two connection-control assemblies on the liquid container or the main body are different.

11. The autonomous cleaning robot as claimed in claim 7, wherein the engagement-control subassembly is disposed within the container body, the second connecting member has a stop position cooperating with the first connecting member and a retracting position apart from the first connecting member, and at least one of the engagement-control assemblies comprises:

a mounting frame, the second connecting member is fixed on the mounting frame, the mounting frame is movably disposed within the container body, and the mounting frame is configured to make the second connecting member move to the stop position or the retracting position;

an operating member, the operating member is mounted on the mounting frame; and an elastic member, a first end of the elastic member abuts against the operating member or the mounting frame, a second end of the elastic member abuts against the container body, and a direction of expansion and contraction of the elastic member coincides with a moving direction of the mounting frame.

12. The autonomous cleaning robot as claimed in claim 7, wherein the engagement-control subassembly is disposed within the container body, the second connecting member has a stop position cooperating with the first connecting member and an retracting position separate from the first connecting member, and at least one of the engagement control assemblies comprises:

a connecting rod, a first end of the connecting rod is provided with the second connecting member;

a toggle piece, the toggle piece is rotatably disposed on the container body, and a second end of the connecting rod is connected to the toggle piece; and a spring, the spring is connected to the first end of the toggle piece and is positioned between the toggle piece and the container body.

13. The autonomous cleaning robot as claimed in claim 1, wherein the first cleaning subassembly is mounted on the main body by a guiding member, when the first cleaning subassembly is mounted on the main body, and the first cleaning subassembly is movable up and down with respect to the main body.

14. The autonomous cleaning robot as claimed in claim 13, wherein the main body comprises a chassis, and the guiding member comprises:

a first guiding ridge, the first guiding ridge is disposed on one of the first cleaning subassembly and the chassis; and a first guiding groove, the first guiding groove is defined on the other one of the first cleaning subassembly and the chassis, and the thickness of the first guiding ridge is smaller than the width of the first guiding groove.

15. The autonomous cleaning robot as claimed in claim 14, wherein the first guiding ridge is disposed on the first cleaning subassembly, and the first guiding groove is defined on the chassis.

16. The autonomous cleaning robot as claimed in claim 1, wherein the obstacle-assisting wheel protrudes out from a surface of the liquid container.

* * * * *